US008169256B2

(12) United States Patent
Yao et al.

(10) Patent No.: US 8,169,256 B2
(45) Date of Patent: May 1, 2012

(54) BANDGAP REFERENCE CIRCUIT WITH AN OUTPUT INSENSITIVE TO OFFSET VOLTAGE

(75) Inventors: Chi-Ping Yao, Renwu Shiang (TW); Wen-Shen Chou, Taipei (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 349 days.

(21) Appl. No.: 12/617,933

(22) Filed: Nov. 13, 2009

(65) Prior Publication Data

US 2010/0207597 A1 Aug. 19, 2010

Related U.S. Application Data

(60) Provisional application No. 61/153,544, filed on Feb. 18, 2009.

(51) Int. Cl.
*G05F 1/10* (2006.01)

(52) U.S. Cl. ..... 327/539; 327/542; 323/313

(58) Field of Classification Search ..... 327/538, 327/539, 542; 323/312, 313, 315, 316
See application file for complete search history.

(56) References Cited

U.S. PATENT DOCUMENTS

| | | | | |
|---|---|---|---|---|
| 6,690,228 | B1 | 2/2004 | Chen et al. | |
| 7,071,767 | B2 * | 7/2006 | Ou-yang et al. | 327/539 |
| 7,211,993 | B2 | 5/2007 | Marinca | |
| 7,224,210 | B2 * | 5/2007 | Garlapati et al. | 327/539 |
| 8,058,863 | B2 * | 11/2011 | Cho et al. | 323/316 |

OTHER PUBLICATIONS

Banba, et al., "A CMOS Bandgap Reference Circuit with Sub-1-V Operation," IEEE, May 1999, pp. 670-674, vol. 34, No. 5.

* cited by examiner

*Primary Examiner* — Long Nguyen
(74) *Attorney, Agent, or Firm* — Slater & Matsil, L.L.P.

(57) ABSTRACT

A circuit includes an operational amplifier including a first input and a second input. A first resistor has a first end coupled to the first input. A first bipolar transistor includes a first emitter coupled to a second end of the first resistor, and a first base. A second bipolar transistor includes a second emitter coupled to the second input, and a second base. A third bipolar transistor includes a third emitter coupled to the first base, a first collector, and a third base connected to the first collector. A fourth bipolar transistor includes a fourth emitter coupled to the second base, a second collector, and a fourth base connected to the second collector. A second resistor is coupled to the first input, wherein the second resistor is parallel to the first resistor and the first bipolar transistor.

20 Claims, 3 Drawing Sheets

BANDGAP REFERENCE CIRCUIT WITH AN OUTPUT INSENSITIVE TO OFFSET VOLTAGE

This application claims the benefit of U.S. Provisional Application No. 61/153,544 filed on Feb. 18, 2009, entitled "Bandgap Reference Circuit with an Output Insensitive to Offset Voltage," which application is hereby incorporated herein by reference.

TECHNICAL FIELD

This invention relates generally to voltage reference circuits, and more particularly to voltage reference circuits implemented using bandgap techniques.

BACKGROUND

Bandgap reference circuits are widely used in analog circuits for providing stable, voltage-independent, and temperature-independent reference voltages. The bandgap voltage reference circuits operate on the principle of compensating the negative temperature coefficient of a base-emitter junction voltage VBE with the positive temperature coefficient of the thermal voltage VT, with VT being equal to kT/q, wherein k is the Boltzmann constant, T is absolute temperature, and q is electron charge ($1.6\times10^{-19}$ coulomb). The variation of VBE with temperature at room temperature is −2.2 mV/C, while the variation of VT with temperature is +0.086 mV/C. Since VT is proportional to absolute temperature, the respective circuit portion is sometimes referred to as a PTAT circuit. Conversely, VBE is complementary to absolute temperature, and hence the respective current portion is sometimes referred to as a CTAT circuit.

As the name suggests, the voltages generated by the bandgap reference circuits are used as references, and hence the outputted reference voltages need to be highly stable. To be specific, the outputted reference voltages need to be free from temperature variation, voltage variation, and process variation. In typical bandgap reference voltage, operational amplifiers are used in order to improve the accuracy of the reference voltages. However, operational amplifiers themselves are not ideal, and have offset voltages. For example, FIG. 1 illustrates bandgap reference circuit 100, in which the offset voltage of operational amplifier 101 is represented by voltage source 102. Ideally, voltages V1 and V2 should equal each other due to the virtual short between the inputs of amplifiers. However, in practical cases, the offset voltage Vos is inevitable. Since the offset voltages Vos vary from chip to chip in a range instead of being a fixed value, the output voltages Vout also vary from chip to chip attributed to the distribution of offset voltages Vos, making it difficult to compensate for such a variation.

U.S. Pat. No. 6,690,228 discloses a bandgap reference circuit less sensitive to offset voltages of the amplifier used therein. It is realized, however, that the sensitivity of the bandgap reference circuits to the offset voltages need to be further reduced to provide more stable reference voltages.

SUMMARY OF THE INVENTION

In accordance with one aspect of the present invention, a circuit includes an operational amplifier including a first input and a second input. A first resistor has a first end coupled to the first input. A first bipolar transistor includes a first emitter coupled to a second end of the first resistor and a first base. A second bipolar transistor includes a second emitter coupled to the second input and a second base. A third bipolar transistor includes a third emitter coupled to the first base, a first collector, and a third base connected to the first collector. A fourth bipolar transistor includes a fourth emitter coupled to the second base, a second collector, and a fourth base connected to the second collector. A second resistor is coupled to the first input, wherein the second resistor is parallel to the first resistor and the first bipolar transistor.

In accordance with another aspect of the present invention, a circuit includes an operational amplifier having a first input and a second input; a first current source providing a first current to the first input; a second current source providing a second current to the second input; a third current source providing a third current; a fourth current source providing a fourth current; and a fifth current source providing a fifth current. The first current, the second current, the third current, the fourth current, and the fifth current mirror each other. A first bipolar transistor includes a first emitter and a first base, wherein the first emitter receives the first current. A second bipolar transistor includes a second emitter and a second base, wherein the second emitter receives the second current. A third bipolar transistor includes a third emitter connected to the first base, a third base, and a first collector, wherein the third emitter receives the third current. A fourth bipolar transistor includes a fourth emitter connected to the second base, a fourth base, and a second collector, wherein the fourth emitter receives the fourth current. An output node receives the fifth current.

The advantageous features of the present invention include reduced sensitivity of the output reference voltages of bandgap reference circuits to the variations in power supply voltages and manufacturing processes.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the embodiments of the present invention are discussed in detail below. It should be appreciated, however, that the embodiments provide many applicable inventive concepts that can be embodied in a wide variety of specific contexts. The specific embodiments discussed are merely illustrative of specific ways to make and use the invention, and do not limit the scope of the invention.

A novel bandgap reference circuit is presented. The variations and the operation of the embodiment are then discussed. Throughout the various views and illustrative embodiments of the present invention, like reference numbers are used to designate like elements.

Figure 1:
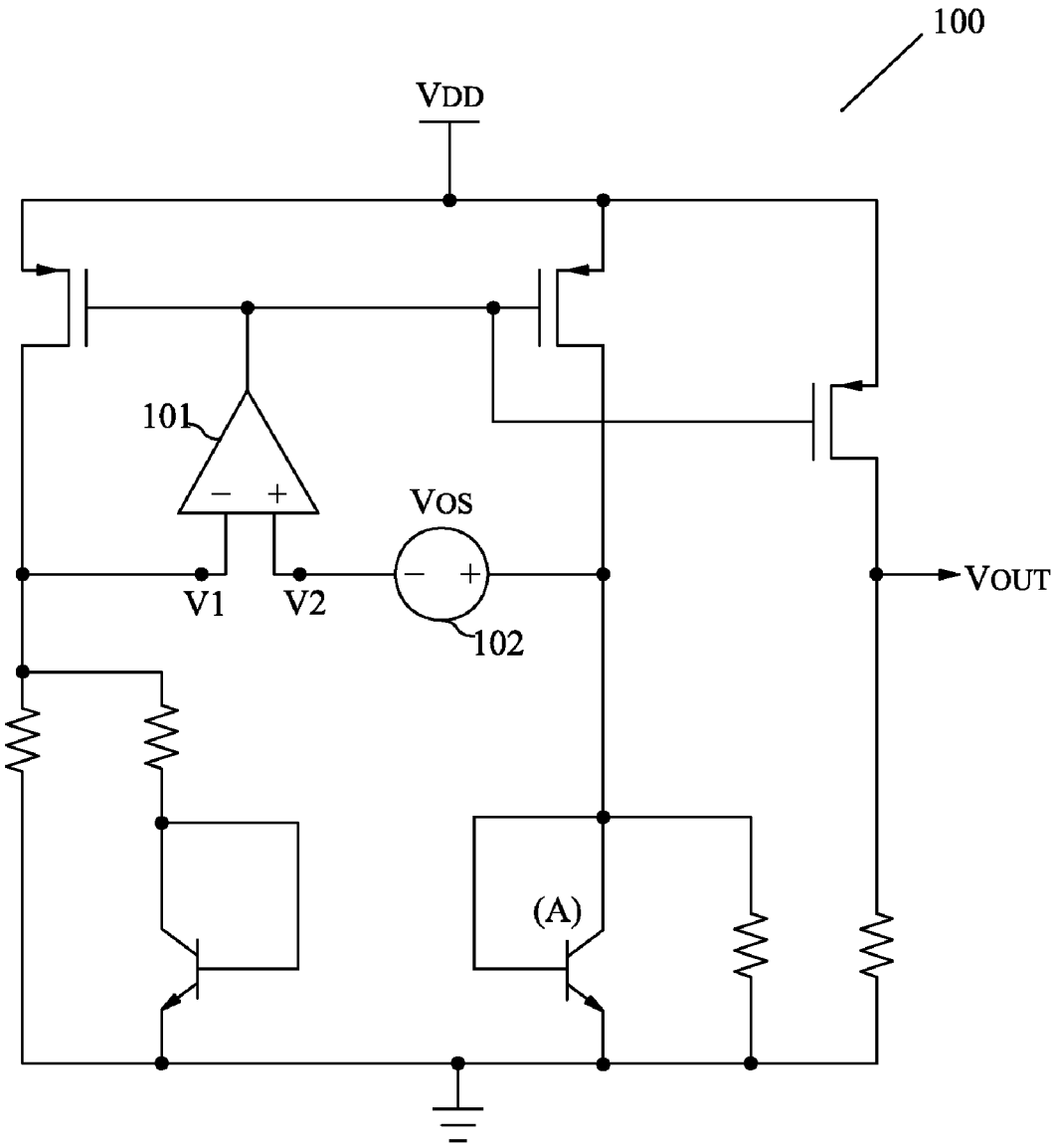
Fig. 1 (Prior Art)
FIG. 1 illustrates a conventional bandgap reference circuit.
Figure 2:
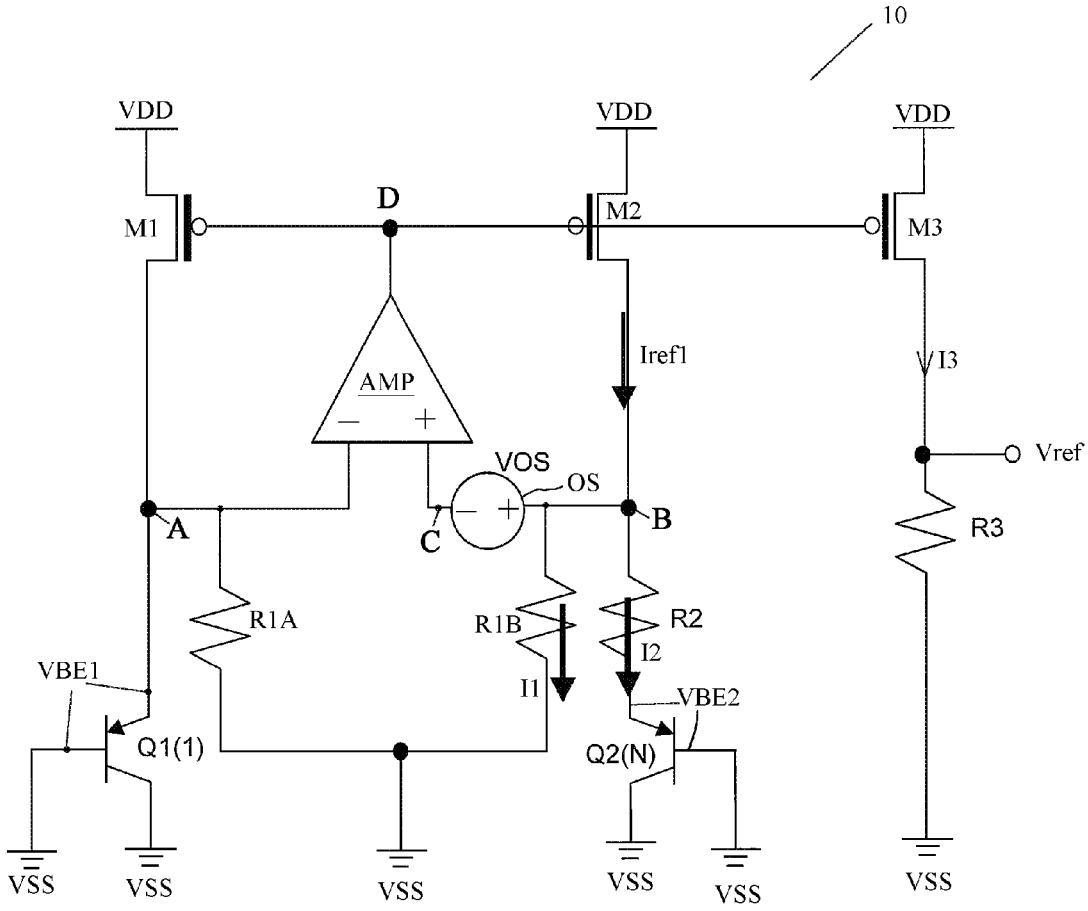
Fig. 2 (Prior Art)
FIG. 2 illustrates a bandgap reference circuit comprising two bipolar transistors, each coupled to an input of an operational amplifier.

FIG. 2 illustrates a conventional bandgap reference circuit 10, which includes operational amplifier AMP. Through PMOS transistors M1, M2, and M3, which receive power from positive power supply voltage VDD, currents are provided to bipolar transistors and resistors. Accordingly, each of PMOS transistors M1, M2, and M3 is a current source. Throughout the description, a path connecting a source and a drain of a MOS transistor is referred to as a source-drain path of the MOS transistor. Operational amplifier AMP includes inputs A, C and output D. Offset voltage source OS is used to symbolize the offset voltage Vos of operational amplifier AMP. Please note that nodes B and C are actually interconnected as a same node since offset voltage source OS is not a real entity. If operational amplifier AMP is ideal, nodes A and B would have a same voltage level due to the virtual connection of nodes A and B. However, due to the offset voltage, the voltage VA at node A no longer equals voltage VB at node B, and voltages VA, VB, and VC have the following relationships:

$$VA=VC \quad \text{[Eq. 1]}$$

$$VB=VC+Vos \quad \text{[Eq. 2]}$$

wherein voltage VC is the voltage at node C. Resistors R1A and R1B are connected to inputs A and C of operational amplifier AMP, respectively, wherein the resistances of resistors R1A and R1B may be the same, and may be denoted as R1. Resistor R2 (whose resistance is also referred to as R2) is connected to node B, and is further connected to the emitter of bipolar transistor Q2. Further, the emitter of bipolar transistor Q1 is connected to node A. Throughout the description, a path connecting an emitter and a collector of a bipolar transistor is referred to as an emitter-collector path of the bipolar transistor. The bases and collectors of bipolar transistors Q1 and Q2 are connected to power supply voltage VSS (and hence are also interconnected), which may be the electrical ground.

The current flowing through resistor R1B is I1, and the current flowing through resistor R2 is I2. Assuming the voltage applied between the emitter and the base of bipolar transistor Q1 is VBE1, and the voltage applied between the emitter and the base of bipolar transistor Q2 is VBE2, and further assuming the difference (VBE1−VBE2) is ΔVBE, then current Iref1 is:

$$Iref1 = I1 + I2 = \frac{VB - VBE2}{R2} + \frac{VB}{R1} \quad \text{[Eq. 3]}$$

According to Equations 1 and 2, it can be derived that:

$$Iref1 = \frac{VBE1 + Vos - VBE2}{R2} + \frac{VBE1 + Vos}{R1} = \frac{\Delta VBE + Vos}{R2} + \frac{VBE1 + Vos}{R1} \quad \text{[Eq. 4]}$$

Equation 4 can be further expressed as:

$$Iref1 = \frac{(R2 \times VBE1 + R1 \times \Delta VBE) + Vos(R1 + R2)}{R1 \times R2} \quad \text{[Eq. 5]}$$

It is realized that the output voltage Vref equals the resistance R3 of output resistor R3 times current I3. Since the gates of PMOS transistors M2 and M3 are interconnected, current I3 mirrors current Iref1 and is proportional to current Iref1. Therefore, the variation in output voltage Vref is proportional to the variation in current Iref1. It is observed in Equation 5 that offset voltage Vos is a part of Rref1 expression, and the variation of offset voltage Vos will be reflected as the variation in current Iref1, and in turn reflected as the variation in output voltage Vref.

Figure 3:
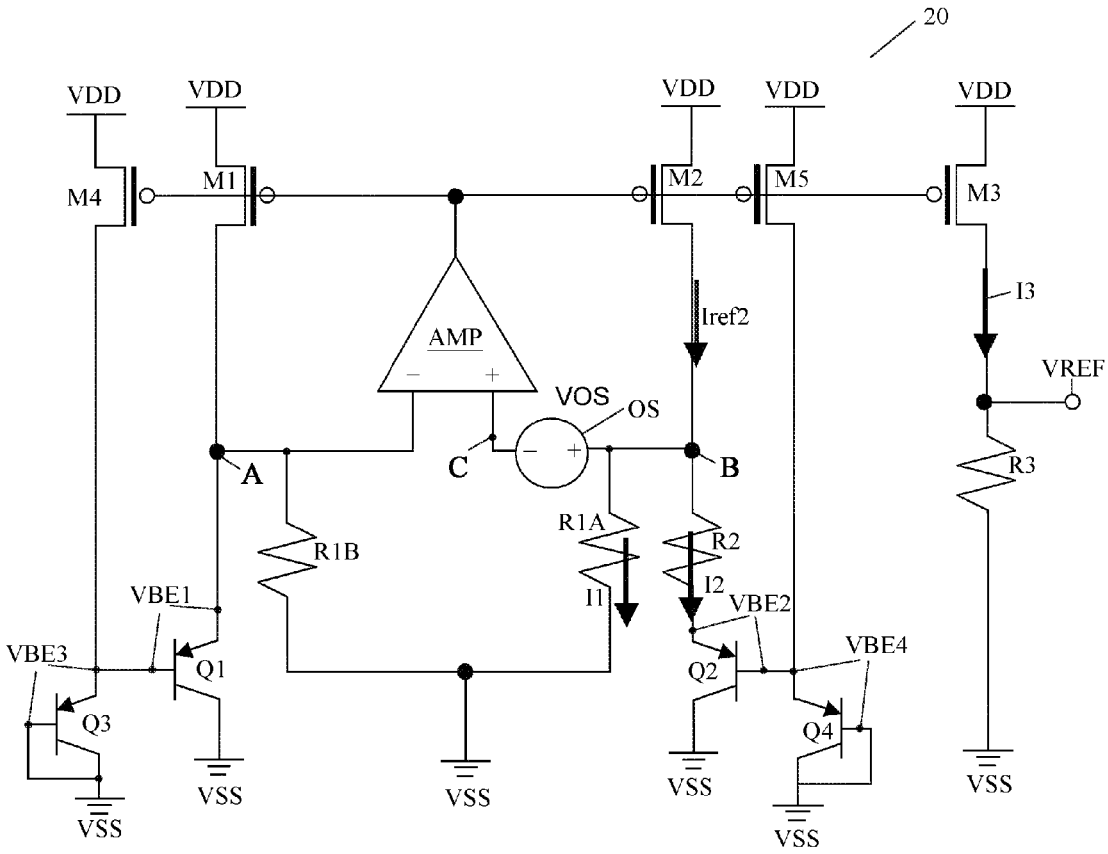
FIG. 3 illustrates a bandgap reference circuit insensitive to the offset voltage of an operational amplifier in the bandgap reference circuit.

FIG. 3 illustrates an improved bandgap reference circuit embodiment, wherein like reference numerals are used to indicate like elements in FIGS. 2 and 3. Besides the devices shown in FIG. 2, bipolar transistors Q3 and Q4 are added, and are supplied with currents by PMOS transistors M4 and M5, respectively, which also act as portions of current sources. Accordingly, the currents flowing through the source-drain paths of MOS transistors M1, M2, M3, M4, and M5 mirror, and are substantially proportional to, each other. In an embodiment of the present invention, bipolar transistors Q1, Q2, Q3, and Q4 are PNP bipolar transistors, although they can also be NPN bipolar transistors. The base and the collector of bipolar transistors Q3 are interconnected, and the base and the collector of bipolar transistors Q4 are interconnected, and may be connected to power supply voltage VSS, which may be electrical ground.

Again, Equations 1 and 2 are still valid. Further, assuming the voltage applied between the emitter and the base of bipolar transistor Q3 is VBE3, and the voltage applied between the emitter and the base of bipolar transistor Q4 is VBE4, and further assuming the difference (VBE1+VBE2)−(VBE3+VBE4) is 2ΔVBE, the following equations may be derived:

$$Iref2 = I1 + I2 = \frac{VB - VBE3 - VBE4}{R2} + \frac{VB}{R1} \quad \text{[Eq. 6]}$$

$$Iref2 = \frac{VBE1 + VBE2 + Vos - (VBE3 + VBE4)}{R2} + \frac{[(VBE1 + VBE2) + Vos]}{R1} \quad \text{[Eq. 7]}$$

Assuming (VBE1+VBE2) may be expressed as 2VBE, then:

$$Iref2 = \frac{2\Delta VBE + Vos}{R2} + \frac{2VBE + Vos}{R1} \quad \text{[Eq. 8]}$$

Accordingly, the following equation may be derived:

$$Iref2 = \frac{2 \times (R2 \times VBE + R1 \times \Delta VBE) + Vos(R1 + R2)}{R1 \times R2} \quad \text{[Eq. 9]}$$

Please note that current Iref2 is derived based on the assumption that no base current flows from the base of bipolar transistor Q1 to the emitter of bipolar transistor Q3, and no base current flows from the base of bipolar transistor Q2 to the emitter of bipolar transistor Q4. In practical situations, there will be small base currents. Accordingly, current Iref2 will be slightly different from what is shown in Equation 9. However, base currents are typically small and have little affection to the derivation of Equation 9.

Comparing Equations 5 and 9, it can be found that the expression Vos (R1+R2) appear in both Equations 5 and 9. On the other hand, the remaining portion 2×(R2×VBE+R1×ΔVBE) in Equation 9 is essentially twice the value of the portion R2×VBE+R1×ΔVBE as in Equation 5. Accordingly, the portion Vos (R1+R2) forms a smaller portion in current Iref2 than in current Iref1. As a matter of fact, since Vos (R1+R2) is only a small portion of both currents Iref1 and Iref2, portion Vos (R1+R2) in Equation 9, which is caused by offset voltage Vos, is essentially half as in Equation 5. Further, if offset voltage Vos has any variation, the resulting variation in current Iref2 is about half as in current Iref1. In other words, the sensitivity of current Iref2 to offset voltage Vos is about 50 percent of the sensitivity of current Iref1.

Again, it is realized that the output voltage Vref equals resistance R3 of output resistor R3 times current I3, while current I3 is proportional to current Iref1 since current I3 mirrors current Iref2. Therefore, the variation in output voltage Vref may be proportional to the variation in current Iref2. Since in the embodiment as shown in FIG. 3, the variation in current Iref2 is reduced due to the reduced effect of offset voltage Vos, as revealed by Equation 9, the variation in output voltage Vref is also reduced.

It is observed that in FIG. 3, the output path (including MOS transistor M3 and output resistor R3) is separated from the inputs of operational amplifier AMP, and the resistance R3 of output resistor R3 may be adjusted to adjust the output voltage Vref, which may either be greater than 1V, or lower than 1V.

Simulation results using Monte Carlo models also proved the significant reduction in the sensitivity of output voltage Vref to offset voltage Vos in the embodiment as shown in FIG. 3. Two groups of samples were made, wherein the first group of samples included 1,000 samples and was made using the bandgap reference circuit as shown in FIG. 3. The second group of samples included 1,000 samples and was made using the bandgap reference circuit as shown in FIG. 2. The results revealed that for the second group of samples, the percentage of samples outside three-sigma (three times the standard deviation) is 14.08 percent. As a comparison, for the second group of samples, the percentage of samples within three-sigma is 6.9 percent, which is essentially half the value 14.08. This means that the product yield loss caused by the distribution of bandgap reference circuits will also be reduced by half. Therefore, the simulation results support the conclusion drawn from Equations 5 and 9.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps. In addition, each claim constitutes a separate embodiment, and the combination of various claims and embodiments are within the scope of the invention.

What is claimed is:

1. A circuit comprising:

an operational amplifier comprising a first input and a second input;

a first resistor comprising a first end coupled to the first input, and a second end;

a first bipolar transistor comprising a first emitter coupled to the second end of the first resistor, and a first base;

a second bipolar transistor comprising a second emitter coupled to the second input, and a second base;

a third bipolar transistor comprising a third emitter coupled to the first base, a first collector, and a third base connected to the first collector;

a fourth bipolar transistor comprising a fourth emitter coupled to the second base, a second collector, and a fourth base connected to the second collector; and a second resistor coupled to the first input, wherein the second resistor is parallel to the first resistor and the first bipolar transistor.

2. The circuit of claim 1 being a bandgap reference circuit, wherein the circuit further comprises:

a first current source providing a first current to the first input;

a second current source providing a second current mirroring the first current;

an output resistor for receiving the second current; and an output node at an end of the output resistor, wherein the output node outputs a voltage of the bandgap reference circuit.

3. The circuit of claim 1 further comprising a third resistor coupled to the second input, wherein the second resistor is parallel to an emitter-collector path of the second bipolar transistor.

4. The circuit of claim 1 further comprising:

a first current source providing a first current to the first input;

a second current source providing a second current to the second input;

a third current source providing a third current to the third emitter of the third bipolar transistor; and a fourth current source providing a fourth current to the fourth emitter of the fourth bipolar transistor, wherein the first current, the second current, the third current, and the fourth current mirror each other.

5. The circuit of claim 4 being a bandgap reference circuit, wherein the circuit further comprises:

a fifth current source mirroring the first current source;

an output resistor for receiving a current provided by the fifth current source; and an output node at an end of the output resistor, wherein the output node outputs a voltage of the bandgap reference circuit.

6. The circuit of claim 1, wherein the first bipolar transistor, the second bipolar transistor, the third bipolar transistor, and the fourth bipolar transistor are PNP transistors.

7. The circuit of claim 1, wherein the circuit is a bandgap reference circuit.

8. A circuit comprising:

an operational amplifier comprising a first input and a second input;

a first current source providing a first current to the first input;

a second current source providing a second current to the second input;

a third current source providing a third current;

a fourth current source providing a fourth current;

a fifth current source providing a fifth current, wherein the first current, the second current, the third current, the fourth current, and the fifth current mirror each other;

a first bipolar transistor comprising a first emitter and a first base, wherein the first emitter receives the first current;

a second bipolar transistor comprising a second emitter and a second base, wherein the second emitter receives the second current;

a third bipolar transistor comprising a third emitter connected to the first base, a third base, and a first collector, wherein the third emitter receives the third current;

a fourth bipolar transistor comprising a fourth emitter connected to the second base, a fourth base, and a second collector, wherein the fourth emitter receives the fourth current; and an output node receiving the fifth current.

9. The circuit of claim 8, wherein the first collector is connected to the third base and the second collector is connected to the fourth base.

10. The circuit of claim 9, wherein the first collector and the third base are connected to an electrical ground and wherein the second collector and the fourth base are connected to the electrical ground.

11. The circuit of claim 8 further comprising a first resistor receiving the first current and coupled in serial with an emitter-collector path of the first bipolar transistor.

12. The circuit of claim 11 further comprising:

a second resistor connected between the first input and a VSS voltage node; and a third resistor connected between the second input and the VSS voltage node, wherein the second resistor and the third resistor have substantially a same resistance.

13. The circuit of claim 8 further comprising an output resistor receiving the fifth current, wherein the output node is connected to one end of the output resistor.

14. The circuit of claim 8, wherein the first bipolar transistor, the second bipolar transistor, the third bipolar transistor, and the fourth bipolar transistor are PNP transistors.

15. The circuit of claim 8, wherein the circuit is a bandgap reference circuit.

16. A circuit comprising:

an operational amplifier comprising a first input and a second input;

a first resistor comprising a first end connected to the first input, and a second end;

a first bipolar transistor comprising a first emitter connected to the second end of the first resistor, and a first base;

a second bipolar transistor comprising a second emitter connected to the second input, and a second base;

a third bipolar transistor comprising a third emitter connected to the first base, a first collector, and a third base connected to the first collector;

a fourth bipolar transistor comprising a fourth emitter connected to the second base, a second collector, and a fourth base connected to the second collector;

a second resistor connected to the first input, wherein the second resistor is parallel to the first resistor and the first bipolar transistor; and a third resistor connected to the second input, wherein the third resistor is parallel to an emitter-collector path of the second bipolar transistor.

17. The circuit of claim 16 further comprising a plurality of PMOS transistors, with drains of each of the plurality of PMOS transistors connected to an emitter of one of the first bipolar transistor, the second bipolar transistor, the third bipolar transistor, and the fourth bipolar transistor, wherein gates of the plurality of PMOS transistors are interconnected.

18. The circuit of claim 16 further comprising:

a first current source providing a first current to the first input;

a second current source providing a second current mirroring the first current;

an output resistor for receiving the second current; and an output node at an end of the output resistor.

19. The circuit of claim 16, wherein the first bipolar transistor, the second bipolar transistor, the third bipolar transistor, and the fourth bipolar transistor are PNP transistors.

20. The circuit of claim 16, wherein the circuit is a bandgap reference circuit.

* * * * *